United States Patent [19]

Pastor

[11] Patent Number: 4,926,575

[45] Date of Patent: May 22, 1990

[54] GUN GRIP EMBLEM MANUAL SAFETY

[76] Inventor: Walter Pastor, 1100 NE. 182 St., North Miami Beach, Fla. 33162

[21] Appl. No.: 366,537

[22] Filed: Jun. 12, 1989

Related U.S. Application Data

[63] Continuation of Ser. No. 286,465, Dec. 19, 1988, abandoned.

[51] Int. Cl.[5] ..... F41C 17/02

[52] U.S. Cl. ..... 42/70.06

[58] Field of Search ..... 42/66, 70.04, 70.05, 42/70.06

[56] References Cited

U.S. PATENT DOCUMENTS

| | | |
|---|---|---|
| 131,845 | 10/1872 | Burrows . |
| 311,323 | 1/1885 | Hopkins . |
| 565,678 | 8/1896 | Foster . |
| 741,754 | 10/1903 | Allen . |
| 1,227,531 | 5/1917 | Donadio . |
| 2,225,583 | 12/1940 | Blizard . |
| 2,994,981 | 8/1961 | Carrigan . |
| 4,091,557 | 5/1978 | Murabito . |
| 4,110,928 | 9/1978 | Smith . |
| 4,154,014 | 5/1979 | Smith . |
| 4,461,110 | 7/1984 | Inderbitzen . |
| 4,719,713 | 1/1988 | Hagle . |
| 4,791,747 | 12/1988 | Pastor . |

*Primary Examiner*—Charles T. Jordan
*Assistant Examiner*—Richard W. Wendtland
*Attorney, Agent, or Firm*—Malin, Haley, McHale DiMaggio & Crosby

[57] ABSTRACT

A manually actuated safety mechanism for a hand gun particularly of the type incorporating a rebound slide which is activated by a small hinged pin mounted on the trigger assembly to force the rebound slide back. The rebound slide has a small indentation in front to receive the pin, to in turn posiiton an internal safety or firing pin block accompanying the gun structure when manufactured, thereby blocking the hammer from engaging the firing pin. The safety mechanism is mounted within the handle of the hand gun and includes minimal moving parts and is disposable and configured to prevent travel of the rebound slide from a blocking position to a release position thereby preventing cocking of the hammer to accomplish proper positioning of the hammer, trigger assembly and firing pin block for the next firing cycle.

11 Claims, 2 Drawing Sheets

GUN GRIP EMBLEM MANUAL SAFETY

This application is a continuation of application Ser. No. 286,465 filed Dec. 19, 1988 now abandoned.

BACKGROUND OF THE INVENTION

1. Field of the Invention

A safety mechanism mounted in the handle of a hand gun and specifically structured to cooperate with the handle or grip stocks disposed on opposite sides of the handle of the gun to the extent that the safety mechanism is manually positioned between a safety position and an operative position by forced linear movement along its own longitudinal axis and the operative components of the safety mechanism may be "disguised" in part as the manufacturer's emblem, logo, etc. found normally on medallions mounted externally on the handle or grip stocks attached to the handle of the gun.

2. Description of the Prior Art

Typically, many prior art revolver type hand guns were absent any positive safety other than a firing pin block or like structure associated with the manufacture of a Smith & Wesson revolver. The firing pin block, as set forth above, is an automatic internal safety which serves to block the hammer from touching the firing pin prior to recocking of the hammer to initiate the next firing sequence. One important purpose behind the firing pin block is to prevent live round in chamber of cylinder from going off due to an accidental sharp blow to the hammer or gun being dropped on the muzzle. The lack of such a positive, manually actuatable safety mechanism and the inherent disadvantages associated with the absence of such a device is acknowledged in U.S. Pat. No. 4,091,557 to Murabito. The recognized problems associated with the design of such safety devices has been one of weight and space since a revolver has to be designed to have a minimum weight and space. Murabito acknowledges that known revolvers such a the "RUGER DOUBLE ACTION REVOLVER" available from Sturm Ruger & Company of Southport, Connecticut are provided with a thumb piece which is movable between a normally opened condition to a normally closed condition, but there is no intermediate or safety position.

Murabito attempts to overcome the problems recognized and existing in the prior art by structurally modifying to some significant extent a common type revolver hand gun such as the Model 10 Smith & Wesson. Such modification involves a structural adaptation of the cylinder latch which can still be used to open the cylinder and be capable of moving it to a "safe" position. In order to adapt a conventional revolver type hand gun, the Murabito invention requires that numerous metal parts and the frame, of the gun be modified substantially involving both time, expense and a certain amount of acknowledged skill in performing these required changes.

Accordingly, even in light of the disclosure found in the above-noted U.S. patent, there is still a need for a simplified safety mechanism capable of being easily applied to a revolver type hand gun without the requirement for performing significant structural alteration of the gun or its working components.

SUMMARY OF THE INVENTION

The present invention relates to a safety assembly particularly of the type designed to be used in combination with a revolver type hand gun of the type which incorporates a rebound slide being biased by a spring (101) in conjunction with trigger lever (21) through hinged pin (23) and rebound slide (21). Typically, a rebound slide is a component of the hand gun which travels to a locking position upon release of the trigger after a firing cycle has been completed. The rebound slide is forced into the locking position by action the internal slide spring, wherein the rebound slide in turn pushes an internal safety or firing pin block up into place blocking travel of the hammer from engaging the firing pin.

Other than the above, most revolver type hand guns do not have any positive action safety which would prevent inadvertent firing of the weapon. However, in the type of hand gun referred to above, the aforementioned rebound slide must travel rearward a relatively small incremental amount, generally in the range of approximately ⅛ inch, to release the firing pin block safety and further, so that the trigger can be pulled back, the hammer can travel rearward to cock and the pawl can turn the cylinder to the next firing position.

The safety mechanism of the present invention provides a positive action safety structure providing a minimal amount of moving parts and which can easily and conveniently be positioned between a safety position and an operative position by the hand holding the gun in an orientation which is ready to fire. The safety mechanism of the present invention comprises a piston assembly including two piston segments wherein one piston segment is longer than the other segment, interconnected together in spaced relation to one another and movable with one another along the longitudinal axis of the piston assembly. The piston assembly is oriented in a substantially transverse relation to the handle of the gun and the handle stock segments located on opposite sides of the gun handle. More specifically, each piston segment is slidably mounted in an appropriately positioned aperture in each handle stock segment. The distance between the piston segments is determined such that the outer end surfaces of each piston segment may be disposed in substantially flush relation to the outer surface of the handle stock portion. Such position defines the safety position of the gun in that the longer of the piston segments will rest behind a specifically structured and configured tail portion which is either silver brazed or integrally formed with the rebound slide. When the piston assembly is in the aforementioned safety position, the piston segment is disposed in interruptive relation to the rebound slide, thereby preventing its rearward movement into a release position such that the remaining components of the action of the hand gun cannot be moved to the firing position or complete a firing cycle.

When in the aforementioned safety position, the interruptive disposition of one piston segment prevents the rebound slide from moving into its release position. Accordingly, the firing pin block or internal safety cannot be released and the trigger cannot be pulled back. Similarly, the hammer cannot travel rearwardly to its cocked position and the cylinder will not be able to turn to the next firing position.

When ready for firing, the piston assembly is moved axially to the operative position defined by one piston segment disposed in a recessed relation to the outer surface of the corresponding handle stock portion while the opposite piston segment protrudes outwardly from the outer surface of the corresponding handle stock portion. In this position, the aforementioned longer piston segment is moved out of interruptive relation or engagement with the travel of the rebound slide to its release position thereby allowing the components of the hand gun action to follow their normal intended path of travel as the gun is activated through its next firing cycle.

Another structural feature of the subject safety assembly is its "disguised" appearance. This is accomplished by affixing or otherwise displaying the conventional gun manufacturer's logo or emblem, commonly in the form of a medallion, on the outer, exposed end surface of each piston segment. It is well known that revolver type hand guns typically include such manufacturer's emblem on the handle stock portions of the gun. Accordingly, the piston segments are specifically sized to adapt to the size of the emblem wherein the emblem or a replica thereof can be mounted on the outer, exposed end surfaces as set forth above. Similarly, apertures, if not previously present, can be drilled in the handle stock in accordance with the dimensions of the piston segments in order that such piston segments be received therein. Except for the tail addition to the rebound slide, no other significant structural modification to the gun need be made and no detailed or expertise labor need be performed on the gun. Any modification would be made directly to the handle stock portion rather than the structural component or frame of the gun itself.

The invention accordingly comprises the features of construction, combination of elements and arrangements of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
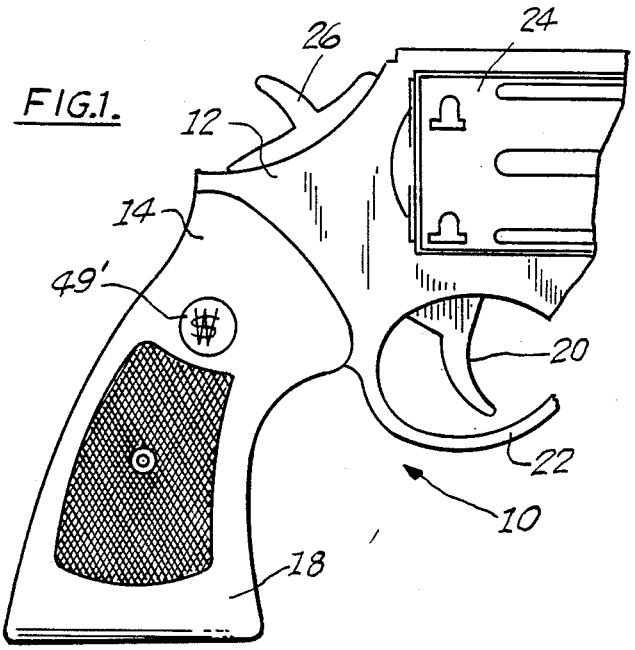
FIG. 1 is a side view in partial cutaway of the handle portion of the gun showing an exposed surface of one handle stock portion with manufacturer's emblem displayed thereon.

As shown primarily in FIGS. 1 through 5A, the present invention relates to a safety assembly of the type designed to be used with a revolver type hand gun 10 typically constructed to include a gun frame 12 integrally secured to or including a gun handle 14 having handle stock portions 16 and 18 secured thereto by a conventional screw-type connector or the like 19. Being of the revolver type, the gun 10 includes trigger 20, trigger guard 22, cylinder 24 and hammer 26. Also included as a component of the revolver type hand gun 10 is the tailed rebound slide 28 mounted in the frame 12.

Figure 7:
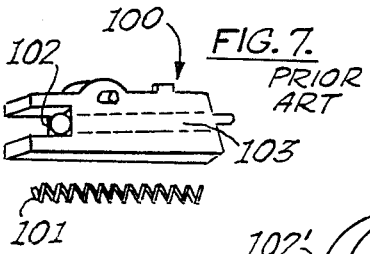
FIG.7. PRIOR ART
FIG. 7 is a detailed view in perspective of the standard rebound slide found in Smith & Wesson revolvers.
Figure 10:
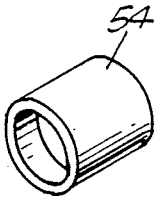
FIG. 10 is a detailed view in perspective of an additional bushing structure of the safety mechanism of the present invention.

FIG. 7 depicts the conventional rebound slide 100 of a Smith & Wesson revolver. The conventional slide is equipped with an interior spring 101 which is located in the interior of the slide in the spring housing 103 which terminates at the exterior of slide 100 at the slide spring aperture 102. It is this interior rebound spring 101 which facilitates the movement of the rebound spring 101 which facilitates the movement of the rebound slide thereby resetting the trigger 16 and the other components for firing.

Figure 8:
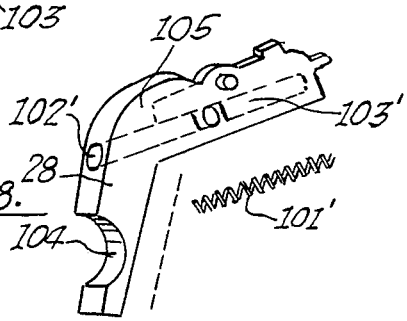
FIG. 8 is a detailed view in perspective of the tailed rebound slide of the present invention.

In the instant invention the conventional rebound slide 100 has been either substituted or modified in such a way to produce a tailed rebound slide 28 of unitary design shown in detail in FIG. 8. To the outer left portion of the conventional slide 100 has been added a tail portion 105 which contains a concave area 104. The concave area 104 enables the engagement of the safety mechanism of the present invention whereby a piston segment 44 of piston assembly 40 is engaged against slide 28 at the concave area 104 thereby locking the tailed rebound slide 28 against the gun frame 12 placing the gun in an interruptive or inoperative position. The spring housing 103' of the modified slide 28 extends into the tail portion 105 terminating at the slide spring aperture 102' thereof The spring 101' creates enough tension to allow free rearward movement of the rebound slide 28 a distance of $\frac{1}{8}$ inch.

The handle 14 also includes a main spring 32 commonly known as a flat main spring having one end anchored or secured as at 34 to the interior of the handle 14. As set forth above, the rebound slide 28 is a component of the gun positionable automatically between a release position (see FIGS. 3, 5 and 5A) and a locked or safety position (see FIGS. 2, 4 and 4A). It functions to initially position the firing pin block (not shown for purposes of clarity) or internal safety in a position which blocks the hammer from touching or engaging the firing pin after the trigger has been released upon the immediate completion of a firing cycle of the gun. The rebound slide then automatically moves to its release position to release the firing pin block from its blocking orientation relative to the hammer and allowing the trigger to be pulled back, the hammer to travel rearwardly into a cocked position and the pawl associated with the cylinder in operative position so that the cylinder can be turned to the next firing position.

Figure 4:
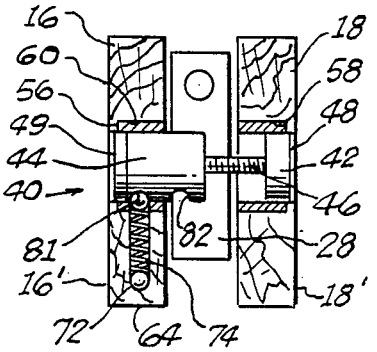
FIG. 4 is a sectional view in partial cutaway along line 4—4 of FIG. 2.
Figure 5:
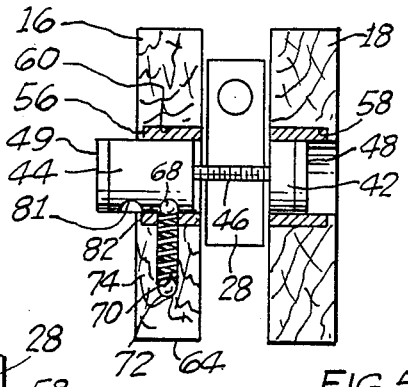
FIG. 5 is a detailed view in partial cutaway along lines 5—5 of FIG. 3.
Figure 5A:
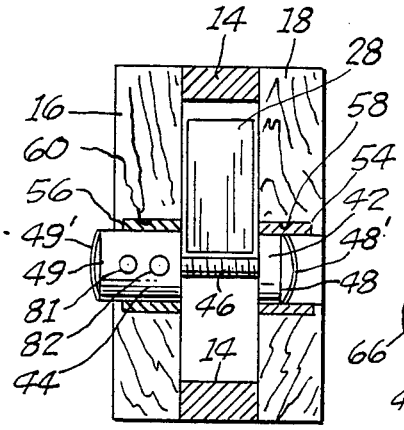
FIG. 5A is a sectional view in partial cutaway of a top view of the embodiment of FIG. 5.
Figure 6:
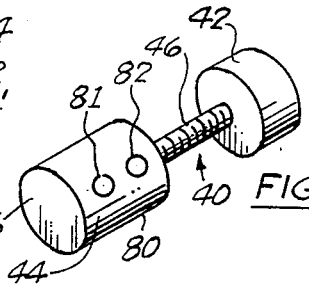
FIG. 6 is a detailed view in perspective of a piston assembly of the subject safety mechanism of the present invention.
Figure 9:
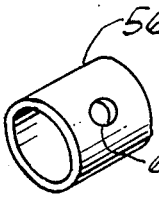
FIG. 9 is a detailed view in perspective of a bushing component of the subject safety assembly.

The safety assembly of the present invention accordingly comprises a piston assembly best shown in FIGS. 4 through 6 wherein the various components thereof are shown in detail in FIGS. 6 through 10. The piston assembly generally indicated as 40 includes two piston segments 42 and 44 interconnected to one another by a connecting rod or shaft 46 with piston segment 44 being longer in length than piston segment 42. In a preferred embodiment both piston segments are ⅜" in diameter with the longer segment 44 being ½" in length and the shorter segment 42 being ¼" long. The connecting shaft 46 preferably has a diameter of 1/16" or less. As shown in FIGS. 4 through 5A, the connecting shaft 46 may be externally threaded and have its opposite ends cooperatively positioned in receiving internally threaded apertures (not shown) within the respective piston segments 42 and 44. The space between the piston segments 42 and 44 may be varied to accomplish a longitudinal dimension sufficient to position the outer end and exposed surfaces of each piston segment 42 and 44 in flush engagement with the outer surfaces 16' and 18' (see FIGS. 4 and 5) of the correspondingly positioned handle segments 16 and 18 respectively. Note that this space must be sufficiently wide to accommodate the thickness of the tailed section of the rebound slide.

Figure 4A:
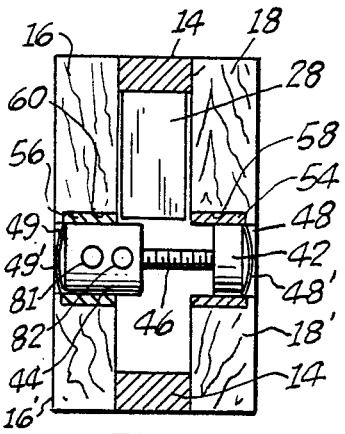
FIG. 4A is a sectional view in partial cutaway of a top view of the structure of FIG. 4.
Figure 2:
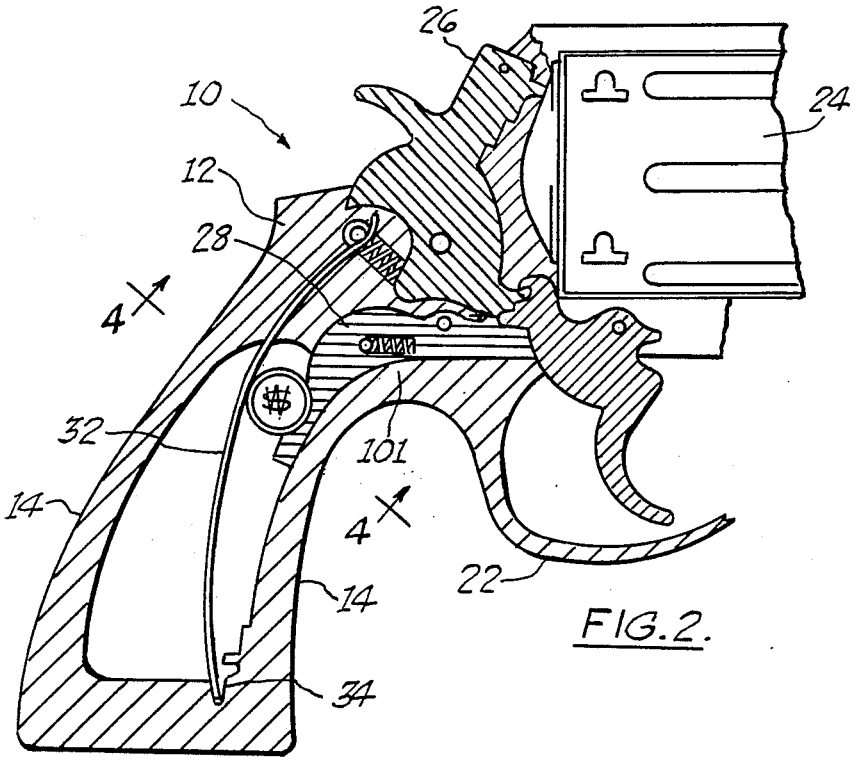
FIG. 2 is a side view of the handle portion of a gun in partial cutaway and schematic showing internal details of the gun in cross section with components of the safety mechanism of the subject invention shown in a safety position.

With primary reference to FIGS. 2–6 the piston segment 44 is longer than piston segment 42 as the rounded section of the longer piston segment 44 becomes stationed in front of the concave area 104 of the tailed rebound slide 28 when the revolver is in the interruptive position clearly shown in FIGS. 2, 4 and 4A. In the interruptive position the rebound slide 28 becomes forced directly against the front strap of the gun frame 12 wherein the firing pin block (not shown) cannot be released and the trigger, hammer and cylinder are prevented from being moved into a ready position to accomplish the next firing cycle. The aforementioned interruptive position may be defined as the safety position in that the gun cannot be fired while the piston assembly 40 is in the interruptive position and in engagement with the rebound slide 28 as set forth above.

This safety position or interruptive position of the piston assembly 40 as clearly shown in FIGS. 4 and 4A is somewhat disguised in that the outer exposed end surfaces 48 and 49 of the respective piston segments 42 and 44 are positioned in substantially flush relation to the outer surfaces 16' and 18' of the respective handle stock portions 16 and 18. The aforementioned disguise is further enhanced by the logo or trademark bearing emblems 48' and 49' being mounted on or defining the outer exposed surfaces 48 and 49 respectively of the piston segments 42 and 44. The observer or user of the gun would assume that the emblems 48' and 49' are conventionally placed since they are both flush with the aforementioned outer surfaces 16' and 18'. The hand gun could therefore not be fired until the piston assembly 40 was moved to its operative or gun firing position as set forth hereinafter.

Figure 3:
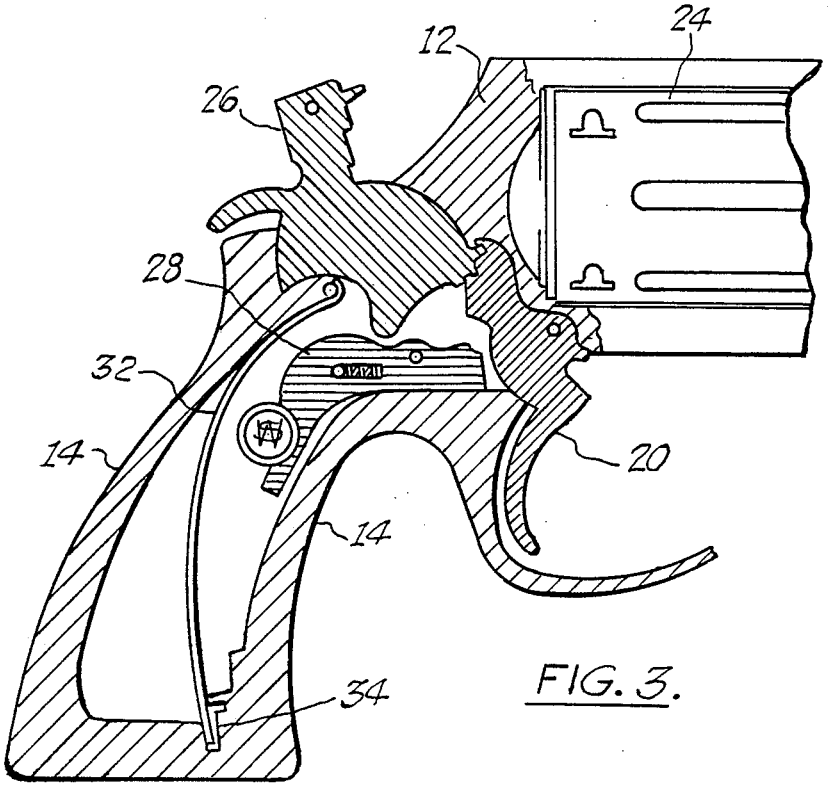
FIG. 3 is a detailed cutaway view in partial section and schematic showing the safety mechanism of the present invention in the operative position.

Movement of the piston assembly to the operative position, for gun firing, is accomplished by a linear, axial movement of the piston assembly 40 into the position shown in FIGS. 5 and 5A such that one piston segment 42 is disposed in recessed relation to the outer surface 16' of the handle segment 16 while the opposite piston segment 44 protrudes outwardly from the outer surface 18' of the correspondingly positioned handle stock segment 18. In the operative position shown in FIGS. 5 and 5A, the long piston segment 44 is out of its interruptive relation or engagement relative to the rebound slide 28 allowing it therefore to assume its release position as shown in FIG. 3 and allow the operative movements of the various components of the gun to assume their position immediately prior to accomplishing a next firing cycle of the gun. It should be obvious that the assembly of the present invention can be adapted for use with a hand gun intended to be used by either a left-handed or right-handed person. More specifically, in the embodiment shown in FIGS. 4 through 5A, the gun is preferably intended to be fired by one holding the handle in his right hand. Accordingly, the surface of the palm would be positioned substantially in flush relation against the outer surface 16' of the stock 16 and the outer surface 49' would protrude outwardly from the outer surface 18'. Conversely, if the gun was to be fired while being held in the left hand, the structure would be reversed including the various components of the subject assembly such that the applicable piston segment would protrude outwardly from the outer surface 16' so as not to interfere with the surface of the palm of the left hand being positioned in flush engagement with the outer surface 18'. It should also be noted that the transverse dimension of the connecting rod 46 is sufficiently small to pass between the main spring 32 and above the concave area of the rebound slide so as to allow movement into the release position as clearly positioned in FIGS. 3, 5 and 5A.

In order to insure ease and efficient movement of the axial or linear travel of the piston assembly 40, two bushings 54 and 56 are respectively mounted in coaxially aligned formed apertures 58 and 60 in the respective handle stock portions 16 and 18. Such bushings 54 and 56 may be pressed or otherwise fixedly secured within the apertures 58 and 60 so as to surround and slidingly receive the respective piston segments 42 and 44 therein as demonstrated in FIGS. 4 and 5. With regard to FIG. 9, it is seen that the bushing 56 also includes an aperture means 62 integrally formed therein. Such aperture means 62 is to allow interconnection of the latch means generally indicated as 64 with an indentation means generally indicated as 66. More specifically, the latch means 64 comprises an end portion which may be in the form of a small spherical member 68 biased into an outwardly projected position by a biasing spring or member 70 wherein the opposite end as at 72 may also include a spherical member or other type of anchoring facility for the biasing spring 70. An appropriately positioned housing sleeve 74 for spring 70 may be press fit or otherwise secured inside a channel integrally formed or drilled into the handle stock 18 as aptly shown in FIG. 4. The biasing spring 70 serves to normally bias the end portion 68 into an outwardly projecting relation and in continuous engagement with the exterior lateral surface 80 of the long piston segment 44. More specifically, the indentation means 66 includes at least two indentations 81 and 82 disposed in spaced relation to one another and linearly aligned both to receive the end portion 68 dependent on whether the piston assembly 40 is in the interruptive or safety position as shown in FIGS. 4 and 4A or the operative position as shown in FIGS. 5 and 5A. The existence of aperture means 62 in the bushing 56 allows interconnection of the end portion 6 with each of the indentations 81 and 82 successively based upon the selective positioning of the piston assembly 40. When such positioning occurs an audible "click" may be heard as end member 68 is repositioned between indentations 81 and 82 in order to indicate to the operator of the gun that a change in position of the safety mechanism has taken place.

Now that the invention has been described,

What is claimed is:

1. A safety assembly for use in combination with a hand gun of the type including a rebound slide disposable between a locking position and a release position relative to movement of a trigger lever, a firing pin block, a trigger and a hammer to accomplish the firing cycle of the hand gun, said assembly comprising:

(a) a piston assembly movably mounted in a handle of the gun and extending transversely therethrough in communicating relation with each oppositely disposed handle stock portion mounted on opposite sides of the handle of the gun, (b) said piston assembly comprising two piston segments, a longer piston segment and a shorter piston segment connected together in spaced apart relation and each movably mounted at least partially within a different one of said handle stock portions, (c) each of said piston segments including an exposed outer end surface and said piston assembly including a longitudinal dimension sufficient to selectively dispose each of said outer end surfaces concurrently in adjacent relation to an outer surface of a respectively positioned handle stock portion, (d) said rebound slide including an integrally formed tail portion of unitary design, said tail portion containing a concave area projecting inwardly therefrom for accommodation of said longer piston segment when said safety assembly is disposed in an interruptive position, said interruptive position defined by a blocking disposition of said longer piston segment relative to said tail portion of said rebound slide as said rebound slide moves between the locking position and the release position thereof, (e) said piston assembly selectively positionable along a longitudinal dimension between a safety position and an operative position, (f) said safety position defined by substantially flush disposition of each outer end surface of said piston segments with the outer surface of the correspondingly positioned handle stock portions, and disposition of said tail portion of said rebound slide in said interruptive position, and (g) said operative position defined by respective recessed and protruding positions of said piston segments relative to correspondingly positioned handle stock portions and disposition of said tail portion of said rebound slide out of said interruptive portion.

2. An assembly as in claim 1 further comprising a latch means for removably stopping said longer piston segment in either said safety position or operative position, said longer piston segment comprising indentation means formed in a lateral exterior surface thereof and disposed in aligned engaging relation with said latch means for engagement of said latch means with said longer piston segment.

3. An assembly as in claim 2 wherein said indentation means comprises at least two indentations disposed in equally spaced relation to one another and each indentation disposed in receiving relation to said latch means along a length of said longer piston segment.

4. An assembly as in claim 3 wherein said safety position is further defined by receiving engagement of said latch means within an outermost one of said indentations and said operative position further defined by receiving engagement of said latch means with an innermost one of said indentations.

5. An assembly as in claim 4 wherein said two indentations are disposed linearly along a length of said longer piston segment and in coplanar relation with said latch means, said piston assembly disposable linearly along its own longitudinal axis to change disposition of said latch means with different ones of said indentations.

6. An assembly as in claim 2 wherein said latch means comprises a latch structure disposed transversely of said longer piston segment and including one end portion dimensioned and disposed for receiving engagement within said indentation means and continuous engagement with said lateral exterior surface.

7. An assembly as in claim 6 wherein said latch structure comprises a biasing means connected to said end portion for biasing thereof outwardly into engaging relation with said longer piston segment and said indentation means.

8. An assembly as in claim 6 further comprising bushing means mounted within said handle stock portion in surrounding relation to each of said piston segments and disposed contiguous to the outer surface of the handle stock portion, said bushing means comprising two bushing elements each including a hollow interior open ended construction, an outer open end of each bushing element disposed in communicating relation with the outer surface of the correspondingly positioned handle stock portion, one of said bushing elements including an aperture means integrally formed therein in alignment with both said latch member and said indentation means for channeling placement of said end portion within one of said indentations.

9. An assembly as in claim 1 further comprising bushing means mounted within said handle stock portions in surrounding relation to each of said piston segments and disposed contiguous to the outer surface of the handle stock portions.

10. An assembly as in claim 9 wherein said bushing means comprises two bushing elements each including a hollow interior, open ended construction, an outer open end of each bushing element disposed in communicating relation with the outer surface of the correspondingly handle stock portion.

11. An assembly as in claim 10 wherein each piston segment is slidingly disposed in surrounded relation within one of said bushing elements and movable coaxially thereto between said safety and said operative positions of said piston assembly.

* * * * *